US006676578B2

(12) United States Patent
Lindqvist

(10) Patent No.: US 6,676,578 B2
(45) Date of Patent: Jan. 13, 2004

(54) STRETCHING DEVICE

(76) Inventor: Tommi Lindqvist, Södra Länggatan 36, 16959 Solna (SE)

( * ) Notice: Subject to any disclaimer, the term of this patent is extended or adjusted under 35 U.S.C. 154(b) by 0 days.

(21) Appl. No.: 10/225,047

(22) Filed: Aug. 20, 2002

(65) Prior Publication Data

US 2003/0040409 A1 Feb. 27, 2003

Related U.S. Application Data

(60) Provisional application No. 60/314,890, filed on Aug. 24, 2001.

(51) Int. Cl.[7] ..... A63B 26/00

(52) U.S. Cl. ..... 482/142; 482/907; 482/148; 482/908

(58) Field of Search ..... 482/142, 148, 482/907, 908

(56) References Cited

U.S. PATENT DOCUMENTS 6,315,702 B1 * 11/2001 Ikonomopoulos ..... 482/138

* cited by examiner

*Primary Examiner*—Nicholas D. Lucchesi
*Assistant Examiner*—L Amerson
(74) *Attorney, Agent, or Firm*—Rolf Fasth; Fasth Law Offices

(57) ABSTRACT

The stretching device has a leg support with an adjustable foot support attached to a first end of an elongate bar. First and second vertical hollow rods are attached to the elongate bar. A horizontal bar is attached to the first and second hollow vertical rods. A third vertical bar is attached to the second vertical hollow rod. An arm support unit is adjustably attached to the third vertical bar and has opposite upwardly bend sections attached thereto and a U-shaped arm holder. A bench unit has an adjustment mechanism to an underside of the bench unit and is insertable into the second vertical hollow bar. The adjustment mechanism has first and second openings for receiving a pin to adjust the horizontal position of the bench unit.

8 Claims, 2 Drawing Sheets

STRETCHING DEVICE

PRIOR APPLICATION

This application claims priority from U.S. Provisional Application No. 60/314,890; filed Aug. 24, 2001.

TECHNICAL FIELD

The present invention relates to a stretching device used for stretching muscles.

BACKGROUND AND SUMMARY OF THE INVENTION

Many different fitness devices have been developed in the past. Many of the conventional devices are often designed for building up more muscles but not for stretching the muscles. Some of the conventional devices may allow for some stretching but it is often necessary to use many different devices to be able to stretch most of the muscles in the human body. For certain muscles group there does not even exist suitable exercise equipment and people use floor and walls etc. to be able to do some stretching. There is a need for an effective stretching device that allows for stretching of most parts of the body in one stretching device.

The stretching device of the present invention provides a solution to the above-outlined problems. The stretching device of the present invention has three general workstations including foot support, arm support and bench units. More particularly, the stretching device has a leg support with an adjustable foot support attached to a first end of an elongate bar. First and second vertical hollow rods are attached to the elongate bar. A horizontal bar is attached to the first and second hollow vertical rods. A third vertical bar is attached to the second vertical hollow rod. An arm support unit is adjustably attached to the third vertical bar and has opposite upwardly bend sections attached thereto and a U-shaped arm holder. A bench unit has an adjustment mechanism to an underside of the bench unit and is insertable into the second vertical hollow bar. The adjustment mechanism has first and second openings for receiving a pin to adjust the horizontal position of the bench unit. An important aspect of the present invention is that the bench unit may be angled or sloped in any suitable angle.

DETAILED DESCRIPTION

Figure 1:
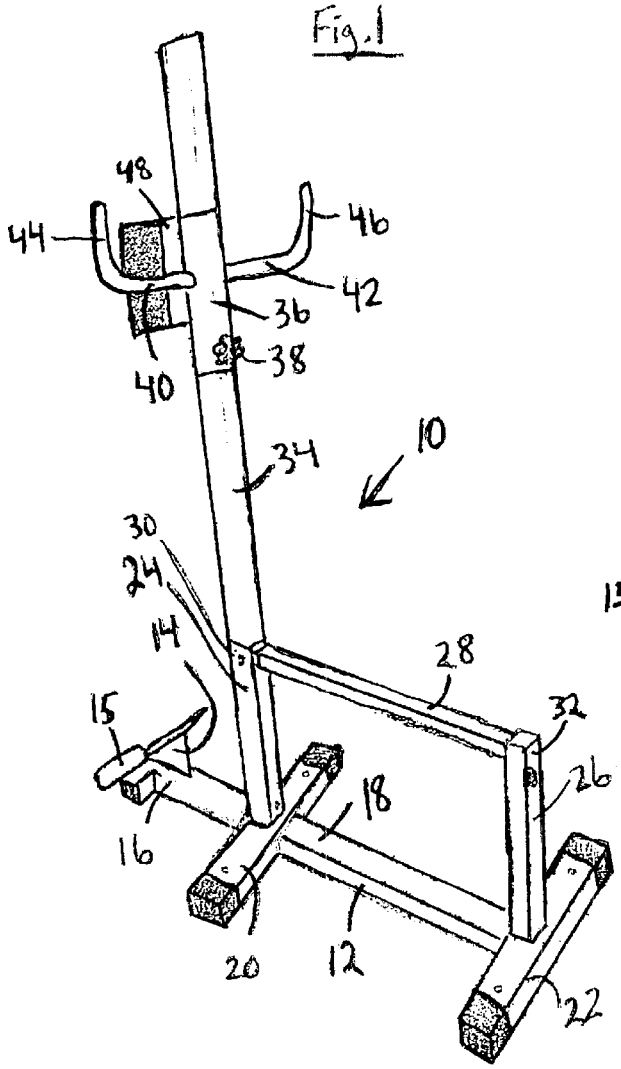
FIG. 1 is a perspective view of the stretching device of the present invention.

With reference to FIGS. 1–6, the stretching device 10 has a leg support 12 with an adjustable foot support 14 attached to one end 16 of an elongate bar 18 of the support 12. An important feature of the stretching device of the present invention is that the parts of the entire body may be stretched using the device. Another important feature is that the stretching device may be used to stretch the muscles of the entire body without having to using several separate stretching devices. The stretching device may also be used to stretch muscles for which there currently exists no suitable exercise equipment.

The support 14 has a back edge 15 that may bear against the heel of a user and the angle of the support 14 may be adjusted, if so desired. It may also be possible to hold the foot of the user to the support 14 by strapping a releasable band around the foot and the support 14. The device 10 may be adjusted to the size and the suppleness of the user that requires stretching. As described in detail below, the device 10 has three general workstations including the foot support 14, an arm support unit 36 and a bench unit 0.

The leg support 12 has parallel legs 20, 22 attached to or integral with the bar 18. A vertical hollow rod 24 is attached to a mid-section of the leg 20 and a vertical hollow rod 26 is attached to a mid-section of the leg 22. A horizontal bar 28 has opposite ends attached to a top end 30 of the rod 24 and to a top end 32 of the rod 26.

Figure 2:
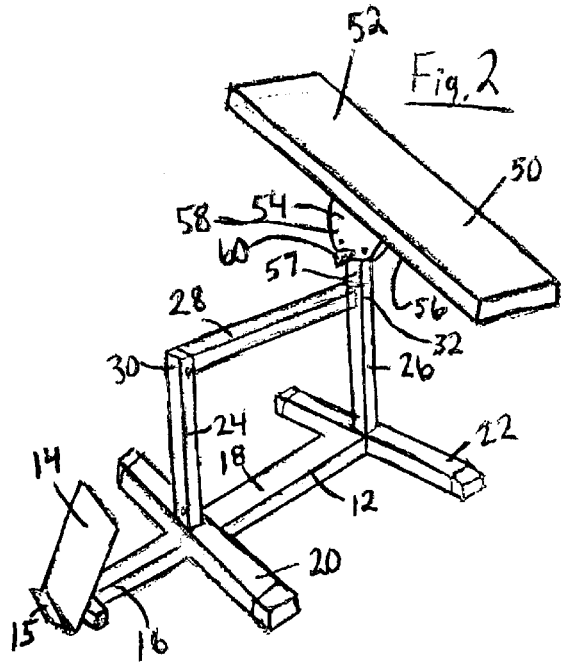
FIG. 2 is a perspective partial view of the stretching device with a bench unit attached thereto.

A vertical bar 34 is inserted into and removably attached to the hollow rod 24. The bar 34 has plurality of holes defined therein to receive a pin to adjustably hold the unit 36 to the bar 34. In this way, the arm support unit 36 is adjustably attached to the bar 34 and a fastening mechanism 38 may be used to tighten the unit 36 to the bar 34 to stabilize the unit 36 and to remove any play between the bar 34 and the unit 36. For example, a spring may be used to accomplish this. The unit 36 has outwardly extending opposite bent rod segments 40, 42 that have upwardly directed sections 44, 46, respectively. A U-shaped arm holder 48 is attached to the unit 36 on a side that is facing away from the horizontal bar 28. The holder 48 may be made of a soft material such as a foam material that is comfortable to rest a lower arm against. The entire unit 36 may be raised or lowered along the bar 34. If desired, the entire bar 34 may be removed from the rod 24, as shown in FIG. 2.

Figure 3:
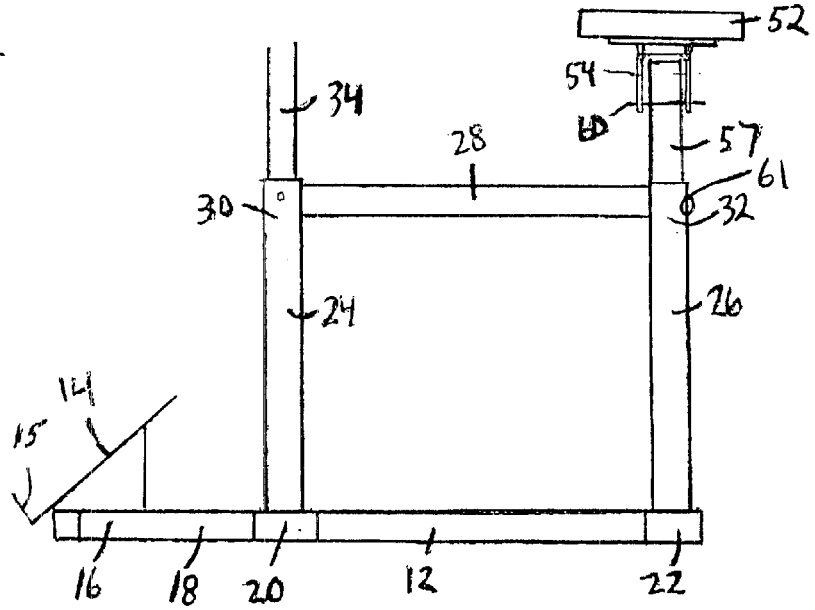
FIG. 3 is an elevational side view of the stretching device.
Figure 4:
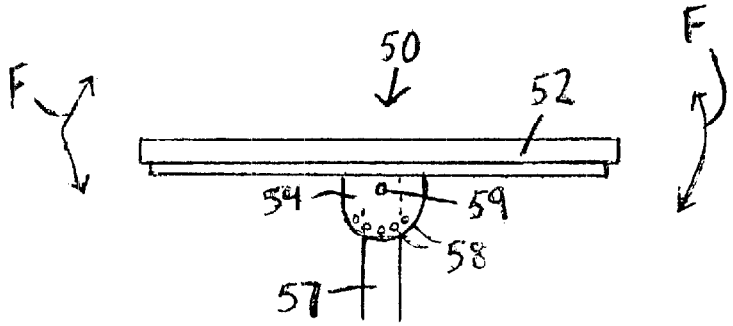
FIG. 4 is a detailed view of the adjustment mechanism of the bench unit.
Figure 5:
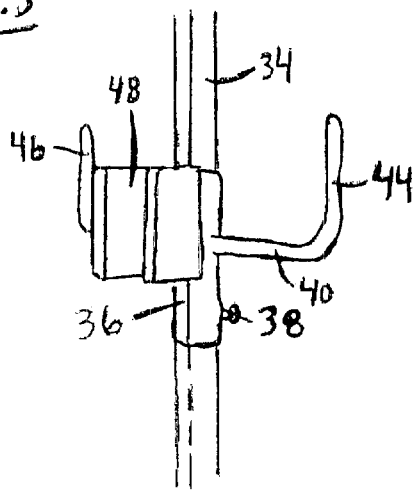
FIG. 5 is a detailed perspective view of the arm and upper body support unit.
Figure 6:
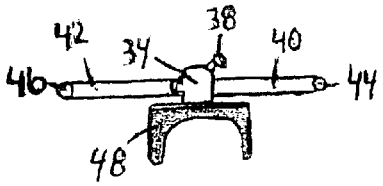
FIG. 6 is a top view of the arm support unit shown in FIG. 5.

The bench unit 50 may be inserted into and attached to the bar 26 so that the height of the unit 50 may be raised or lowered as desired. The unit 50 has a rectangular shaped cushion 52 and an adjustment mechanism 54 attached to an underside 56 of the cushion 52. The bench unit may also have cavities for the foot or thigh for improved comfort and effectiveness. The mechanism 54 has a downwardly directed bar 57 that may be inserted into and attached to the bar 26. The bar 57 may be tightened to the bar 26 with a fastening mechanism 61, such as a tightening screw, that is very similar to the fastening mechanism 38. The mechanism 61 may cooperate with a fastening pin on the back of the bar 26. The mechanism 54 may be used to set an angle of the cushion 52 by pivoting the plate 52 about a pivot pin 59 so that the cushion 52 may be sloping at a desirable angle, as shown by arrows F, relative to a horizontal plane, such as the floor. The mechanism 54 is U-shaped, as best shown in FIG. 3, and has a plurality of openings 58 at a lower end of the mechanism 54. The angle of the cushion 52 may be set by inserting a pin 60 through one of the openings 58 and through the bar 57 to lock the cushion 52 into a desirable sloping or horizontal position. If desired, the plate 52 may also be rotated about the bar 57.

Figure 7:
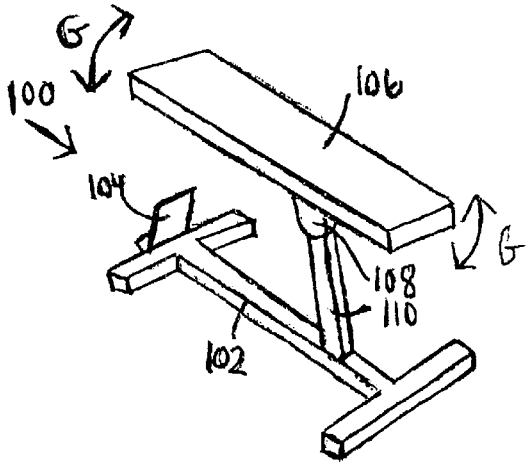
FIG. 7 is an elevational side view of an alternative stretching device of the present invention.

With reference to FIG. 7, an alternative embodiment 100 of the stretching device is shown. The stretching device 100 has a support 102 and a footrest 104 attached thereto. The support 102 may have wheels at one end so that the unit may be rolled on a floor. A plate 106 is attached by an angle mechanism 108 to an upright bar 110 attached to the support 102. Preferably, the mechanism 108 is attached to a point that is about two-thirds of the length of the plate 106. Similar to the function of the mechanism 34, the angular or sloping position of the plate 106 may be adjusted by the mechanism 108 as shown by the arrows G. The device 100 may be made foldable so that it is easy to bring to sports events such as soccer games.

In operation, the size of the device is adjusted to the size of the user. The biceps of a user may be stretched by turning away the body from the unit 36 and holding the hand on one of the sections 44, 46. The triceps may be stretched by placing an elbow in the holder 48 and leaning towards the holder 48 while the hands are placed behind the neck. The chest muscles may be stretched by placing a lower arm in the holder 48 with the side of the body facing the holder 48. The holder 48 may also be lowered to stretch shoulder and back muscles. The bench unit 50 is particularly suited for stretching the leg muscles and other muscles. For example, the underside of the thigh muscles may be stretched by placing a leg on top of the cushion 52 and leaning forward. A person may also lay with the back on the cushion 52 and have a second person stretch the legs and other parts of the body. The calf muscles may be stretched by placing a foot on the footrest 14 and leaning the body forwardly.

It is possible to produce each component of the device separately and the mounted on an existing or conventional exercise equipment. It may also be possible to produce the components together with a device. For example, the bench unit may be mounted on a conventional stationary bicycle trainer or leg exercise equipment. The foot device for stretching the calf muscles may be mounted on or manufactured together with a calf-training device or stationary running device. Instead of mounting the entire device directly on to the floor, it is possible to attach the device to a movable floor plate.

While the present invention has been described in accordance with preferred compositions and embodiments, it is to be understood that certain substitutions and alterations may be made thereto without departing from the spirit and scope of the following claims.

I claim:

1. A stretching device, comprising:

a leg support with an adjustable foot support attached to a first end of an elongate bar;

a first vertical hollow rod attached to the elongate bar;

a second vertical hollow rod attached to a second end of the elongate bar, the second end being opposite the first end;

a horizontal bar attached to the first and second hollow vertical rods, the horizontal bar being disposed above and spaced apart from the elongate bar;

a third vertical bar attached to the second vertical hollow rod;

an arm support unit adjustably attached to the third vertical bar, the arm support unit having opposite upwardly bend sections attached thereto and a U-shaped arm holder, the arm holder being attached to the arm support unit on a side that is facing away from the horizontal bar;

a bench unit having an adjustment mechanism to an underside of the bench unit, the adjustment mechanism being insertable into the second vertical hollow bar and attached thereto; and the adjustment mechanism having a first opening and a second opening defined therein for receiving a pin, the bench unit being movable from a horizontal position to a sloping position by moving the pin from the first opening to the second opening.

2. The stretching device according to claim 1 wherein the foot support has a back edge attached thereto.

3. The stretching device according to claim 1 wherein the elongate bar has parallel legs attached thereto for added stability of the stretching device.

4. The stretching device according to claim 1 wherein the third vertical bar is insertable into and removably attached to the first vertical hollow rod.

5. The stretching device according to claim 1 wherein the arm support unit is made of a soft material.

6. The stretching device according to claim 1 wherein the arm support unit is raisable and lowerable relative to the third vertical bar.

7. The stretching device according to claim 1 wherein the adjustment mechanism has a downwardly directed bar that is insertable into the second hollow vertical rod.

8. The stretching device according to claim 7 wherein the bench unit is rotatable about the downwardly directed rod.

* * * * *